US006435340B1

(12) United States Patent
Bowes, Jr.

(10) Patent No.: US 6,435,340 B1
(45) Date of Patent: Aug. 20, 2002

(54) REVERSIBLE KEY CASE/SQUEEZING DEVICE

(76) Inventor: James Bowes, Jr., 23 Newbury Nech Rd., Newbury, MA (US) 01951

( * ) Notice: Subject to any disclaimer, the term of this patent is extended or adjusted under 35 U.S.C. 154(b) by 2 days.

(21) Appl. No.: 09/711,246

(22) Filed: Nov. 9, 2000

Related U.S. Application Data

(60) Provisional application No. 60/165,560, filed on Nov. 15, 1999.

(51) Int. Cl.[7] ..... A45C 11/32
(52) U.S. Cl. ..... 206/37.8; 206/38.1; 206/37.1
(58) Field of Search ..... 206/37.1, 37.3, 206/37.4, 37.8, 38.1, 235

(56) References Cited

U.S. PATENT DOCUMENTS 1,220,171 A 3/1917 Bershum
1,509,829 A * 9/1924 Doty
2,086,378 A * 7/1937 Butler
4,934,528 A * 6/1990 Miller et al. ..... 206/235
5,042,649 A 8/1991 McNutt
5,682,981 A * 11/1997 Sudborough ..... 206/38.1
D446,007 S * 8/2001 Gillilan

* cited by examiner

*Primary Examiner*—David T. Fidei

(57) ABSTRACT

A protective case for keys, comprised of a sleeve constructed from an elastic based fabric, and a split ring. The sleeve is mounted to the ring in a method that allows it to be reversed inside out, and allows one half of the ring to always be contained within the sleeve. The keys are attached to one side of the split ring. By reversing the orientation of the sleeve, the keys are then captured on the interior of the sleeve. The elastic fabric of the sleeve applies pressure to the keys, preventing them from rattling amongst themselves, this protects the keys from damage and eliminates the rattling noise.

3 Claims, 7 Drawing Sheets

REVERSIBLE KEY CASE/SQUEEZING DEVICE

CROSS REFERENCE TO RELATED APPLICATIONS

Provisional Application 60/165,560 Filed Nov. 15, 1999.

BACKGROUND—FIELD

This invention relates to devices for holding keys, particularly devices that can offer protection to the keys.

BACKGROUND—PRIOR ART

There exist a wide variety of inventions made to hold and protect keys. The prior art most relevant to this application is McNutt 5042649. This invention is a key case which is comprised of a reversible sac with a wide open end, and a narrow closed end. The open end has a pressure foot comprised of elastic sewn into the sac. The result is that when the sac in inverted, the keys end up inside the sac. The elastic keeps the open end closed so that the keys are not inadvertently let out of the sac.

There are a number of shortcomings in this Mcnutt design. The first shortcoming is that, even though keys may be secure on the interior of the sac, the keys still have room to rattle amongst themselves. This rattling can cause damage, and can cause noise, which is distracting or annoying, to the user.

The second shortcoming is the method by which the key ring is attached to the sack. The key ring is attached to a chain link, which is attached to the sack via a metal eyelet, which is mated to the closed end of the sack. This method is cumbersome to assemble and expensive to manufacture.

The third shortcoming is the size of the invention, the methods by which the Mcnutt design is comprised require a chain link to attach to an eyelet. A key ring is attached to the key and to the chain line, the result is that the distance between the eyelet and the key, is almost as long as the key itself. This additional length makes the device bulky and awkward to carry.

SUMMARY

In accordance with the present invention a key case is comprised of a sac of a thin elastic material, capable of compressing contents within the sac. The sac has a wide open end, and a narrow closed end. A split ring is sewn directly into the thin end of the sac, providing a central position to mount keys. The keys can be contained within the sac if the user so desires, by turning the sac inside out. When the keys are on the inside of the sac, they are compressed together by the elastic material of the sac, thus rendering them motionless relative to each other.

The purpose of this invention is to provide a simple method to protect keys when they are not in use and to eliminate the rattling noise that happens when keys are carried together on a split ring keychain. When carried on this type of device the keys are free to rattle amongst themselves and scratch any surface they may come in contact with. This invention prevents the keys from rattling by putting a protective layer of elastic fabric between the keys and other items. The invention also eliminates annoying rattling noises caused by the keys by compressing them together.

Rattling keys can be a major distraction whilst driving a vehicle. Another simple use of this invention is to mount the ignition key for your car on one side of the ring, and the remainder of your keys on the opposite side. When driving the car, only the ignition key will be exposed, the remaining keys will not rattle, therefor not creating any distracting noise which can potentially cause the operator to cause an accident. Using the invention this way will also prevent the loose keys from scratching the dashboard of the vehicle.

Also, many cars are now equipped with keyless entry devices, which are small remote controls that attach to your key chain. These devices are subject to damage from shock and weather. This invention also provides protection for these devices.

OBJECTS AND ADVANTAGES

Several objects and advantages of the present invention are:

(a) to provide a key case which can easily protect its contents (b) to provide a key case that prevents the keys from rattling (c) to provide a key case that is small and unobtrusive to the user (d) to provide a key case that is easy and inexpensive to manufacture (e) to provide a key case that squeezes its contents (f) to provide a key case that allows a primary key to be mounted in a way in which it is separated from other keys, in such a way that the other keys are compressed and protected while the primary key is free to be used. Particularly in the case of operating a motor vehicle.

(g) to provide a key case that allows the user to easily attach it to other objects, such as belts, bags, backpacks, etc.

(h) to provide a key case that can be manufactured out of one piece of fabric.

Further objects and advantages of the invention are the direct safety correlation of the invention. Rattling keys can cause distraction to operators of motor vehicles. Anything that can be done to reduce distractions will aid the operators' ability to safely operate the vehicle. Still further objects and advantages will become apparent from a consideration of the ensuing description and drawings.

DRAWING FIGURES

Figure 3:
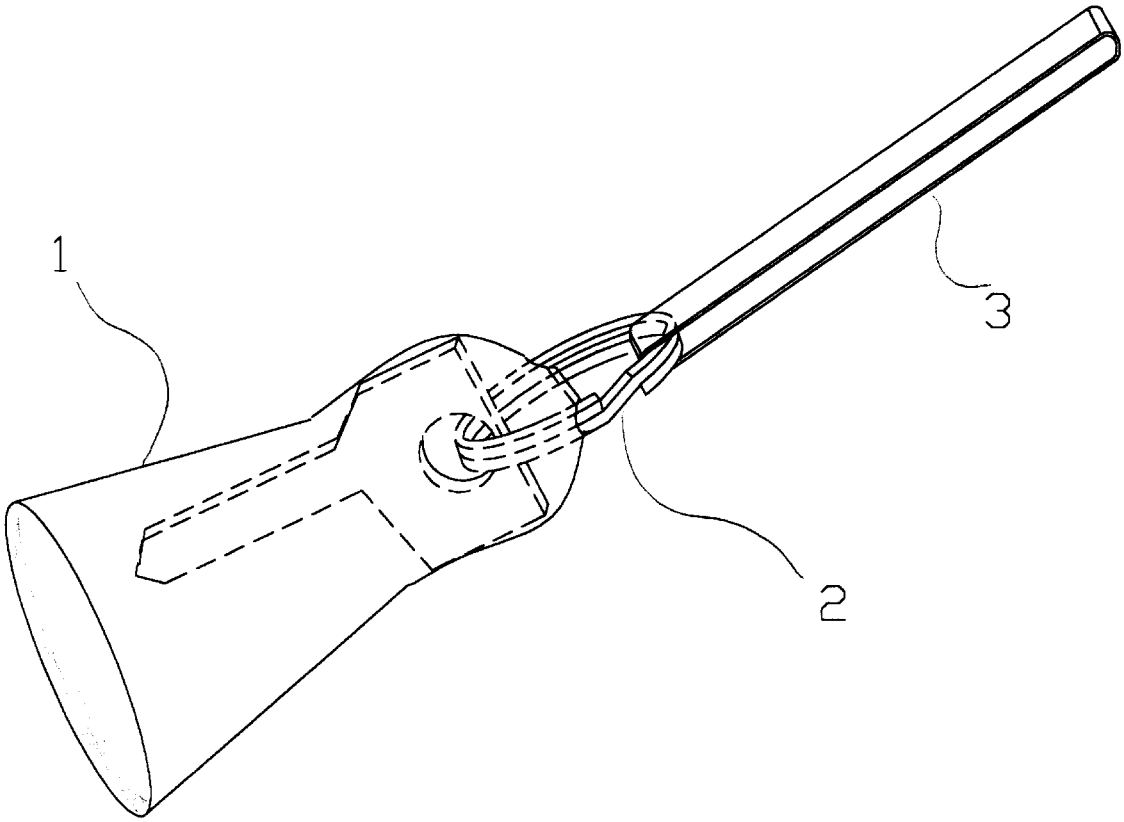
FIG. 3 is a view of the apparatus in the closed position, with a key contained within. Note the stretch of the elastic fabric.
Figure 3A:
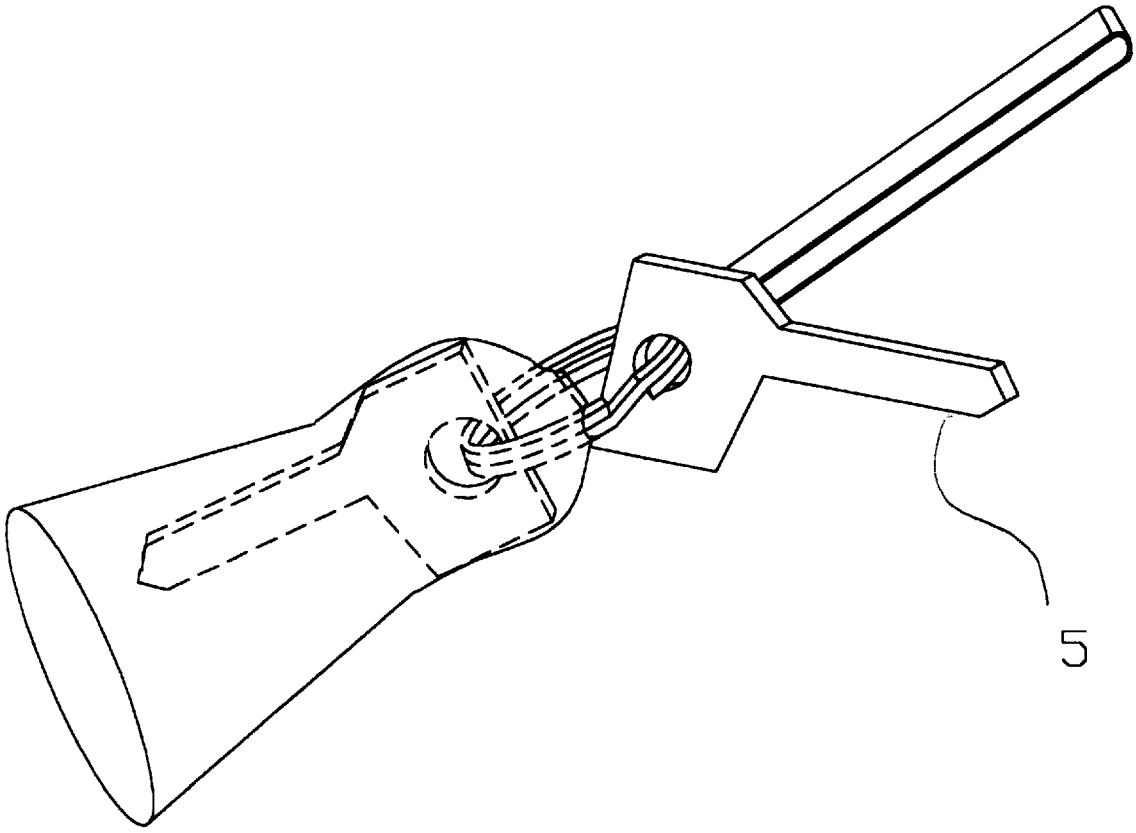

FIG. 3*a* shows the apparatus in the closed position, with a key contained, and a primary key attached to the opposite side of the ring.

Figure 4:
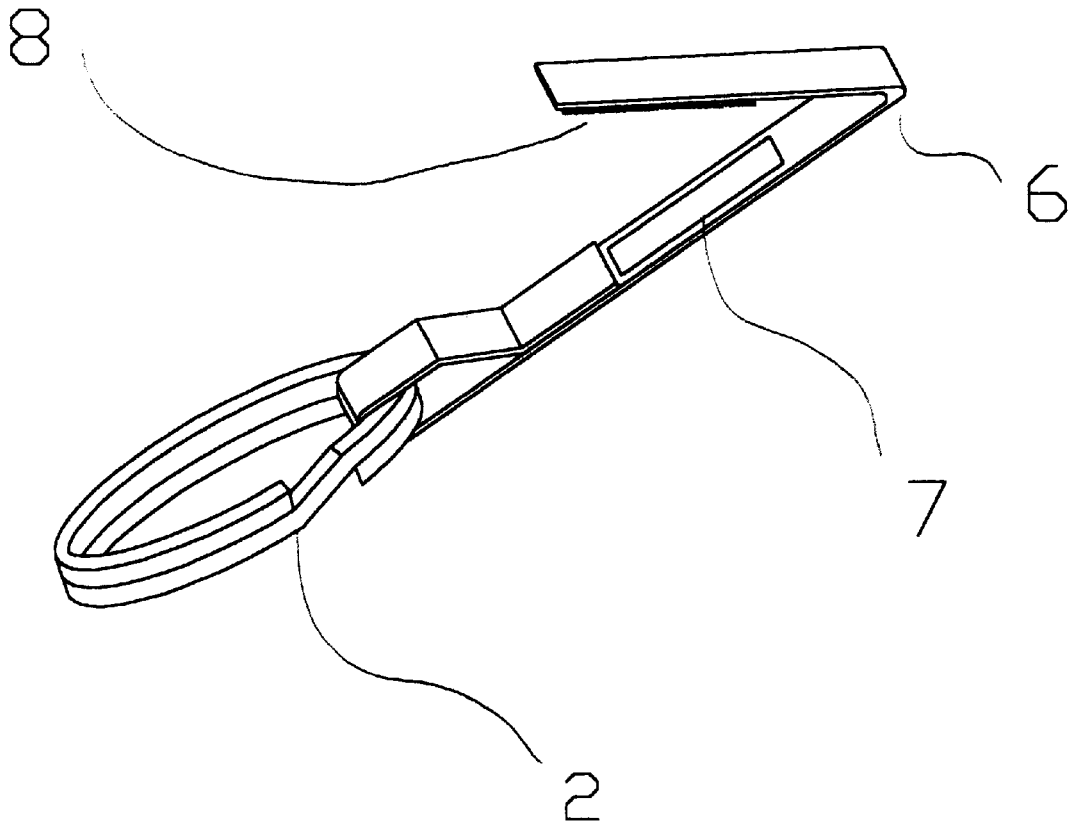

FIG. 4 is a view of the pull tab, showing the positioning hook and loop fastener to allow the tab to be used to attach to other objects.

Figure 5:
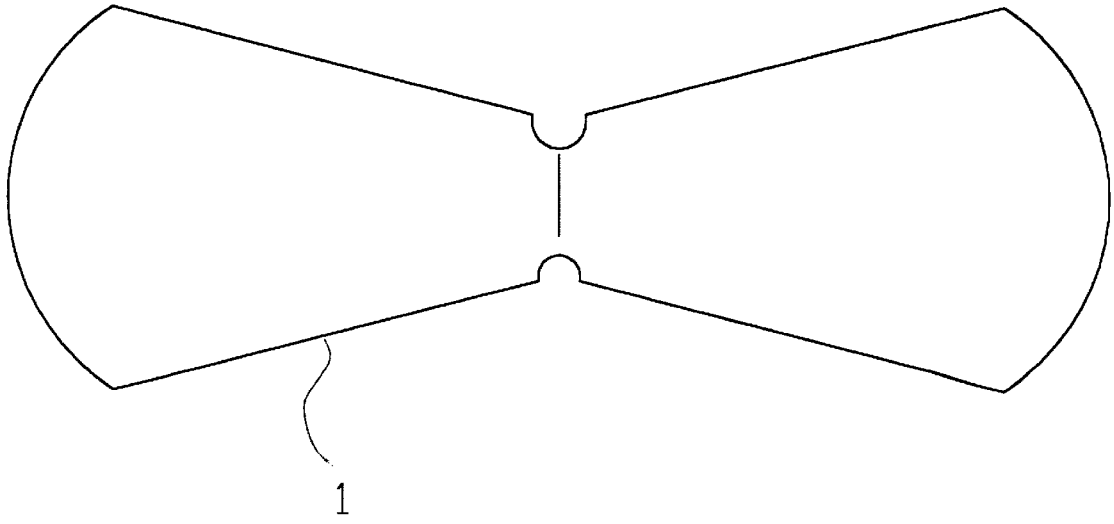

FIG. 5 is a flat view of the elastic fabric before it is assembled.

Figure 6:
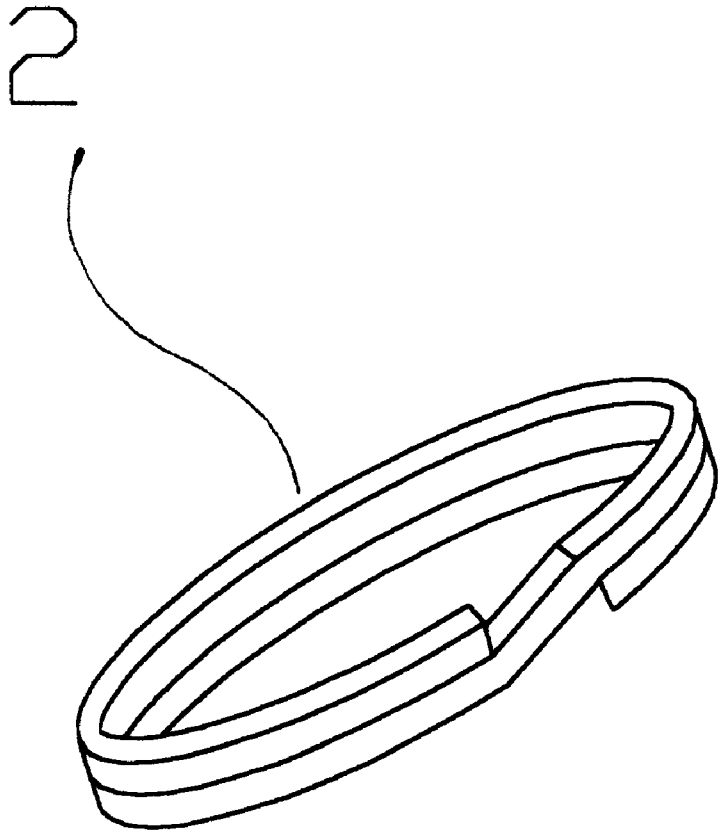

FIG. 6 is a view of the split ring.

REFERENCE NUMERALS IN DRAWINGS

1. Elastic Fabric Sleeve
2. Split Ring

3. Pull-Tab
4. Key
5. Primary Key
6. Modified Pull-Tab
7. Loop fastener
8. Hook fastener

DETAILED DESCRIPTION

Figure 1:
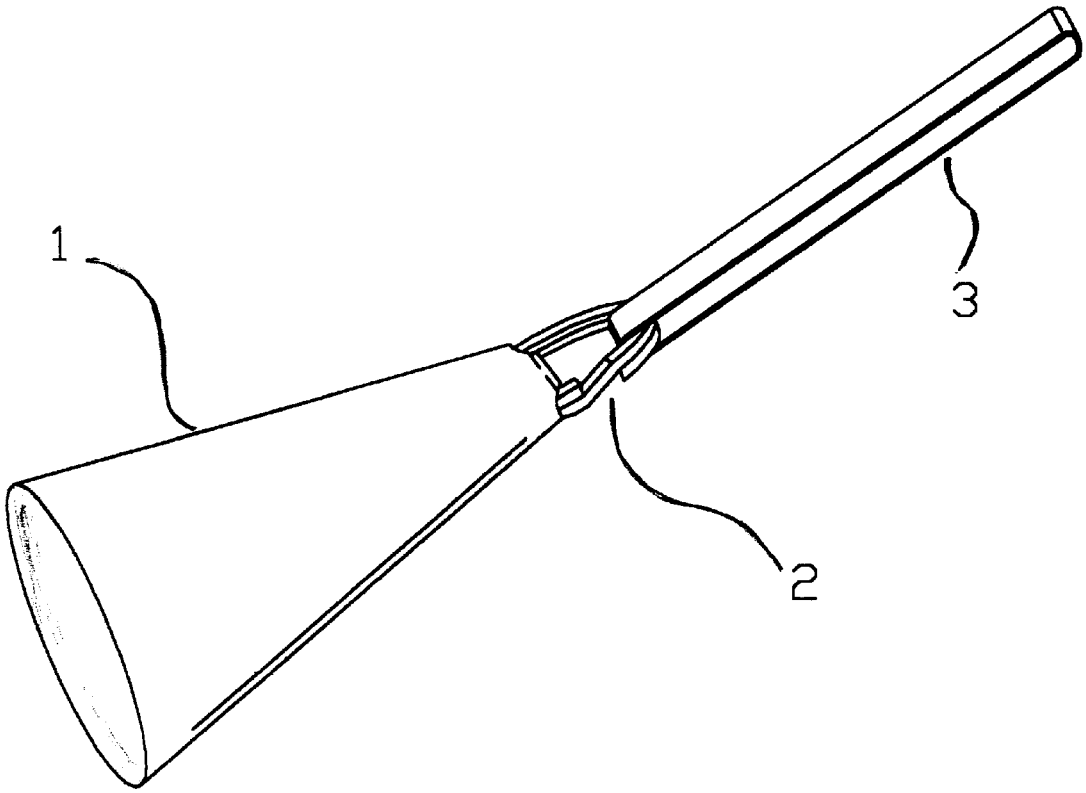
FIG. 1 is a view of the apparatus in the closed position, with no keys attached or contained.

FIG. 1, shows the invention in the closed position, with no keys attached. Split Ring 2 is attached to Pull-Tab 3. Elastic Fabric Sleeve 1 is also attached to Split Ring 2. Elastic Fabric Sleeve is assembled by folding the two halves of the sleeve, FIG. 5, together, and sewing or adhering the two side edges to each other. Before the sleeves are adhered, Split Ring 2, FIG. 6, is positioned so that half of the sleeve is passed through the Split Ring, Thus rendering the configuration as shown in FIG. 1.

Figure 2:
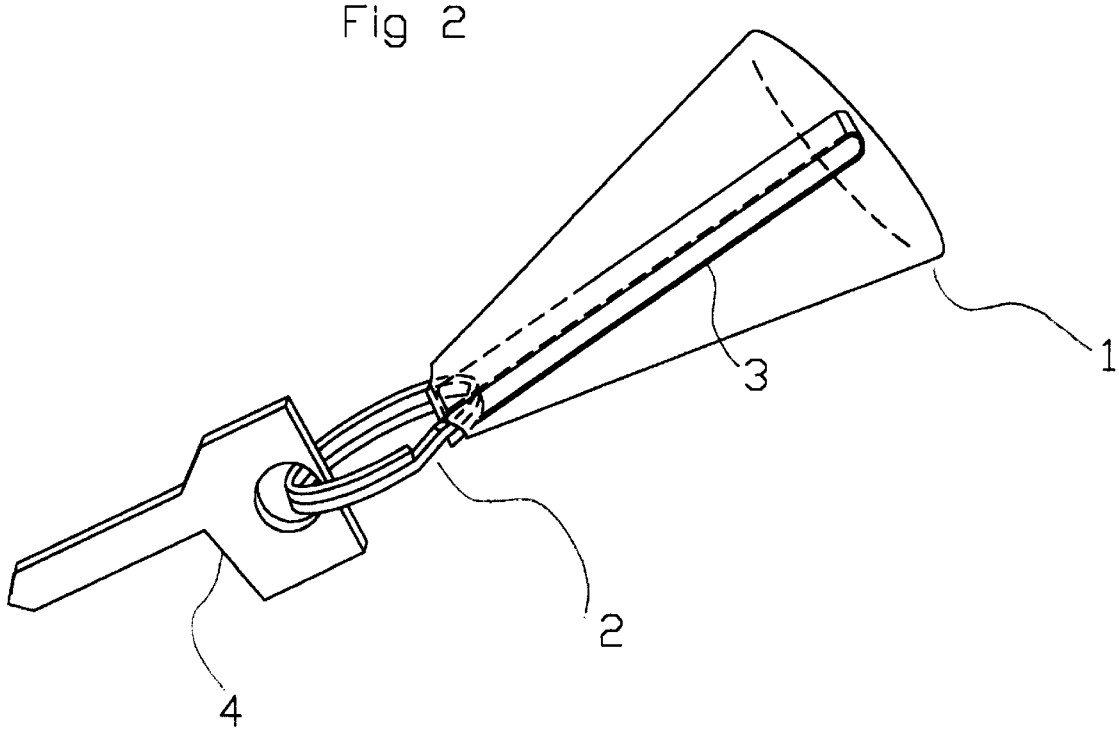
FIG. 2 is a view of the apparatus in the open position with a key attached.

FIG. 2, shows the invention in the open position. Sleeve 2 is folded inside out leaving Pull Tab 3 on the inside of the sleeve. Key 4, is the attached to the Split Ring. In this open position, any keys attached to this side of the split ring are accessible for use.

FIG. 3, shows the invention in the closed position, with the affixed Key 4, contained within. This is achieved by once again turning the sleeve inside out. This is done with the aid of Pull-Tab 3, which allows the user to gain the grip and necessary leverage to easily reverse the orientation of the sleeve. With out the pull-tab, the user would have to grab down through the sleeve in order to grab hold of the ring. Once the ring was grabbed, it could be pulled up through the middle of the sleeve. Effectively turning it inside out. The Elastic Fabric Sleeve 1, by the nature of its elastic fabric, allows only a tight interior space, which may be difficult for most users to easily grab the ring, had they not been using the Pull-Tab 3.

FIG. 3, for drawing clarity, only shows one key contained within the invention. In most practical applications, multiple keys will be attached. When more than one key is attached, the elasticity of the sleeve fabric, will serve to compress the contained keys together.

FIG. 3 A, shows an additional Primary Key 5, attached to the Split Ring. This configuration shows the Primary Key 5 attached to the open side of the ring, with the sleeve in the closed position, with Key 4 contained within the sleeve. In this configuration, the user can keep his Primary Key separate from the other keys. This will allow the use of the Primary Key while the other keys are contained within the closed sleeve.

FIG. 4 shows a Modified Pull Tab 6, which includes a hook and loop fastening system. The Hook Fastener 8 on the underside of the tab, mates with Loop Fastener 7, when the tab is folded onto itself The Modified Pull Tab 6, is secured to the Split Ring 2, by folding a portion of itself over the tab, and adhering or sewing it to itself The result is that the Modified Pull Tab is attached to the Split Ring, and has a movable portion which can be secured via the hook and loop fastener.

Advantages

From the description above, a number of advantages of the Reversible Key Case/Squeezing Device become evident.

A) Keys no longer rattle amongst themselves, creating distracting and annoying sounds.

B) Keys no longer rattle causing damage and wear

C) The keys are protected from damaging or scratching other objects.

D) The case allows the user to place certain keys on opposite sides, so that they can be used while the other keys are protected.

E) The case protects other objects, such as a car dashboard, from scratches caused while one of the attached keys is in use.

Operation of Invention

The device is utilized by turning the sleeve inside out, so that the pull-tab is no longer visible. With the device in the open position, the user attaches their keys to the visible portion of the split ring. The user than turns the assembly inside out again, back to the closed position. Thus rendering the keys securely inside the sleeve. The tab is utilized as a handhold to facilitate the easy turning of the assembly inside out. The tab can also be manufactured with a hook and loop fastener (velcro) overlap, which enables the tab to be used to attach the device to other objects.

The primary function of the invention is to compress the contained keys by using an elastic fabric to construct the sleeve. The case is designed so that when empty, there is very little room on the inside of the sleeve. Once the keys are located within the closed sleeve, the sleeve material stretches to accommodate their mass. This stretching function applies a force back on the contents, thus squeezing the different keys or contents together.

Conclusion, Ramification, and Scope

Accordingly, the reader will see that the use of the Reversible Key Case/Squeezing Device can be used to conveniently and easily protect and contain keys by means of squeezing said keys on the inside of an elastic fabric sleeve. The case is made in a manner where the user can conveniently open and close the case, by simply turning the sleeve inside out. By mounting a split key ring in such a way that allows one half of the ring to be on the inside of the sleeve and the other half on the outside, the user has a small, compact device that allows the keys to be protected and prevents distracting rattling sounds. But, also allows for the mounting of a primary key on the opposite side, so that the user can use the primary key to operate a vehicle while the remaining keys are securely contained within the case. To access the remaining keys the user simply reverses the sleeve inside out. This action removes the keys from the confinement applied by the internal pressure of the elastic fabric sleeve.

The use of the Reversible Key Case/Squeezing Device provides the user with a convenient and useful means of protecting not only the keys in the case, but other objects that may inadvertently be damaged by contact with the keys. But most importantly, the compressing features of the elastic fabric sleeve, eliminates the noise associated with the rattling that can be caused by movement amongst the keys. This noise has the potential to distract a motor vehicle operator thus increasing the risk of an accident.

The scope of the invention should be determined not by the embodiment(s) illustrated, but by the appended claims and their legal equivalents.

Having described the invention, what is claimed is:

1. A key case comprised of:

a) a thin, pliant, reversible sleeve manufactured from an elastic based fabric, said elastic fabric constructed in a manner whereas its applies pressure to the contents of the sleeve, b) a split ring capable of holding keys, c) said sleeve constructed in a manner that allows the ring to mount by passing through two holes in the sleeve, said holes positioned to allow half of the ring to be enclosed on the inside of the reversible sleeve and half on the outside, thus allowing the mounting of keys on either side of the sleeve;

whereas keys may be mounted on to the split ring, said keys would then either be securely contained within the elastic sleeve by the action of reversing the orientation of the sleeve by turning it inside out, said pressure from the sleeve would thus render the keys motionless with respect to each other, or certain keys, if desired, could be mounted on the opposite side of the sleeve, allowing access to the desired keys, while simultaneously containing the keys mounted on the other side.

2. They key case of claim 1 where a tab is mounted on to the split ring in such a manner that the tab aids in the process of reversing the sleeve by providing the user an easy an convenient point to hold on to the ring, while pulling said ring through the inside of the sleeve, thus reversing the configuration.

3. The key case of claim 2 where the tab is constructed with an overlapping hook and loop fastener attachment said attachment allowing the tab to be used to secure the key case to other objects.

* * * * *